US006736766B1

(12) United States Patent
Gallant

(10) Patent No.: US 6,736,766 B1
(45) Date of Patent: May 18, 2004

(54) DYNAMIC TENSIONER INCORPORATING STEPLESS RATCHET DEVICE

(76) Inventor: Raymond J. Gallant, 48-239 Waiahole Valley Rd., Kaneohe, HI (US) 96744

( * ) Notice: Subject to any disclaimer, the term of this patent is extended or adjusted under 35 U.S.C. 154(b) by 314 days.

(21) Appl. No.: 09/699,558

(22) Filed: Oct. 31, 2000

Related U.S. Application Data

(63) Continuation-in-part of application No. 09/304,981, filed on May 4, 1999, now Pat. No. 6,139,476.
(60) Provisional application No. 60/195,273, filed on Apr. 7, 2000.

(51) Int. Cl.[7] ..... A63B 21/012; A63B 21/015
(52) U.S. Cl. ..... 482/114; 482/115; 482/118
(58) Field of Search ..... 81/58.4, 59.1, 81/60, 63.1; 482/114, 115, 118, 119; 403/148, 149

(56) References Cited

U.S. PATENT DOCUMENTS

| | | | | |
|---|---|---|---|---|
| 2,543,729 | A | | 2/1951 | Magida |
| 2,725,232 | A | | 11/1955 | Magida |
| 4,374,588 | A | * | 2/1983 | Ruggles |
| 4,850,585 | A | * | 7/1989 | Dalebout |
| 5,535,647 | A | * | 7/1996 | Donaldson, Jr. |
| 5,557,994 | A | | 9/1996 | Nakayama |
| 5,788,618 | A | * | 8/1998 | Joutras |
| 5,980,435 | A | * | 11/1999 | Joutras et al. |
| 6,079,532 | A | * | 6/2000 | Marks |
| 6,082,512 | A | * | 7/2000 | Marks |
| 6,139,476 | A | * | 10/2000 | Gallant |

* cited by examiner

*Primary Examiner*—Jerome W. Donnelly
*Assistant Examiner*—Fenn C Mathew
(74) *Attorney, Agent, or Firm*—Siemens Patent Services, LC

(57) ABSTRACT

A rotational drive device that provides both variable levels of adjustable rotational resistance and also selective direction in which the resistance acts. The device has two mutually rotatable members each having a grasping handle. One member has a shaft serving as an axle for rotatably supporting the second member. A nut threads to the end of the shaft. When tightened, the nut imparts axially compressive forces urging the two rotatable members towards one another. The base rotatable member has a ramped member facing a corresponding opposed ramped member rotatably supported on the shaft. When the ramped members are rotated relative to one another, overall axial length of the base member is adjusted. This adjustment selectively modifies resistance to rotation of the rotatable members. A clutch device selectively transmits resistance forces when one rotatable member is rotated relative to the other in a first direction, in a second direction, and in both directions. When one direction is selected, the two members rotate with minimal resistance. The clutch has curved cam surfaces which bind in a smooth, stepless manner without causing chattering and vibration typical of pawl ratchets.

12 Claims, 4 Drawing Sheets

DYNAMIC TENSIONER INCORPORATING STEPLESS RATCHET DEVICE

REFERENCE TO RELATED APPLICATION

This application claims priority benefit of Provisional Patent Application Serial No. 60/195,273, filed Apr. 7, 2000, and is a continuation-in-part of Utility patent application Ser. No. 09/304,981, filed May 4, 1999 now U.S. Pat. No. 6,139,476.

BACKGROUND OF THE INVENTION

1. Field of the Invention

The present invention relates to a rotational drive device that provides both variable levels of adjustable rotational resistance and also selective direction in which the resistance acts. The invention finds application in exercise equipment wherein a user overcomes the resistance when using the equipment. The device may comprise an exercise device having two handles to be grasped by the two hands of the user, who rotates the handles relative to one another, or alternatively may be incorporated into a more complicated machine.

2. Description of the Prior Art

Many different types of rotational exercise devices have been designed in the past. Most of these exercisers include means to adjust the rotational resistance in one or both directions. What is lacking in the prior art is a rotational exercise device that can be adjusted to provide selectively variable resistance in either one or both of opposed directions, and which offers selection of the direction of resistance.

Exercise devices are shown in U.S. Pat. Nos. 2,543,729 and 2,725,232, issued to Herbert N. Magida respectively on Feb. 27, 1951, and Nov. 29, 1955. In both cases, the subject devices include two handles, one for each hand of the user, and an adjustably variable frictional resistance element. Resistance is the same regardless of direction of rotation of one handle relative to the other. By contrast, the present invention enables the user to select the rotational direction in which resistance acts. Optionally, resistance acts in both directions.

U.S. Pat. No. 5,788,618, issued to Frank Edward Joutras on Aug. 4, 1998, describes an exercise device having a ratchet mechanism and an adjustable resistance feature. However, Joutras lacks a directional selector for selecting direction of resistance, as seen in the present invention.

U.S. Pat. No. 5,557,984, issued to Tatsuo Nakayama on Sep. 24, 1996, shows a ratchet wrench which includes torque adjustment and an adjustable selector for selecting the direction of resistance. A ratchet wrench is intended to rotatably drive a device such as a threaded fastener to the point of tightness, and therefore lacks a second handle as seen in the present invention, which second handle would be appropriate for exercise devices. Also, a wrench intended for rotating a fastener would not provide resistance in two opposed directions, with the consequence that no significant progress could be achieved in turning a fastener.

The prior art devices, in addition to failing to show the combination of variable resistance and selection of direction in which the resistance acts, lacks a stepless ratchet mechanism. As employed herein, stepless ratchet action signifies action from which arise neither the sound nor the tactile characteristics of a rapidly oscillating or striking sequence generated by a ratchet wherein a pawl contacts a series of steps in rapid progression. None of the above inventions and patents, taken either singly or in combination, is seen to describe the instant invention as claimed.

SUMMARY OF THE INVENTION

The present invention is a dynamic tensioner particularly suitable for use in exercising. The tensioner includes two rotatable members which rotate about a common axis. In one embodiment, the tensioner has two handles each grasped in one hand by the user, wherein one handle is attached to each rotatable member. A frictional resistance element opposes relative rotation of the two handles. The tensioner incorporates both a directional selector and a variable resistance adjuster. The device therefore provides variable resistance to rotation of the rotatable members and associated handles, which resistance may be varied both in magnitude and in direction. More specifically, the variable resistance selectively acts in either one of two opposed rotational directions, wherein almost no resistance acts in the opposite rotational direction, or alternatively, equal resistance in both rotational directions. Thus three directional options are provided by the selector, in addition to selection of level of frictional resistance provided by the resistance adjuster.

The directional selector is a three position dial which biases a plurality of cams into one of three possible positions to transmit selected frictional resistance forces only when the first member is rotated clockwise relative to the second member, only when the first member is rotated counterclockwise relative to the second, and in both rotational directions. The tension adjuster includes a threaded fastener which compresses the two rotatable members into mutual engagement. As increasing axial forces press the two members together, frictional resistance to rotation increases. The two members undergo only partial rotation relative to one another. Alternatively stated, they move only through a limited arc of motion.

This motion, combined with selected frictional resistance, allows specific muscle conditioning for any limb of the body which engages one handle of the tensioner. The two handles or their corresponding members may pit effort of one limb against effort exerted by another limb. Alternatively, one handle or corresponding member may be immobilized, with only one body limb engaging a handle or corresponding member. In the latter example of usage, a single body limb is subjected to exercise. Thus the present invention is particularly suited for physiological sculpting.

A clutch transmits compressive forces from the tension adjuster which generate resistance in selected mutual rotational directions. The clutch, unlike a stepped pawl and ratchet device, acts steplessly. That is, motion of one rotatable member relative to the other proceeds smoothly in both directions without causing rapid vibrations or chatter typical of stepped pawl and ratchet devices.

In the preferred embodiment, the frictional resistance element comprises two members having opposed, interfitting, complementary ramps. The members are formed from a mildly elastic, strong material such as a steel alloy. When ramps of each member are pressed against one another, each ramp deforms slightly to accommodate passage of its opposed counterpart.

Accordingly, it is one object of the invention to provide a dynamic tensioner which varies both magnitude and direction of resistance forces acting on two mutually rotatable members.

It is a second object of the invention to enable alternating direction of the two mutually rotatable members by stepless ratchet action.

Another object of the invention is to provide a dynamic tensioner which is engaged by, selectively, one or two limbs of a user, and which pits effort of one arm against selected resistance forces.

It is a further object of the invention that the tensioner provide selectively variable frictional resistance to rotation of one rotatable member relative to the other rotatable member.

Still another object of the invention to enable a user to select one of two opposed directions of rotation or both directions when subjecting the rotatable members to frictional resistance to rotation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
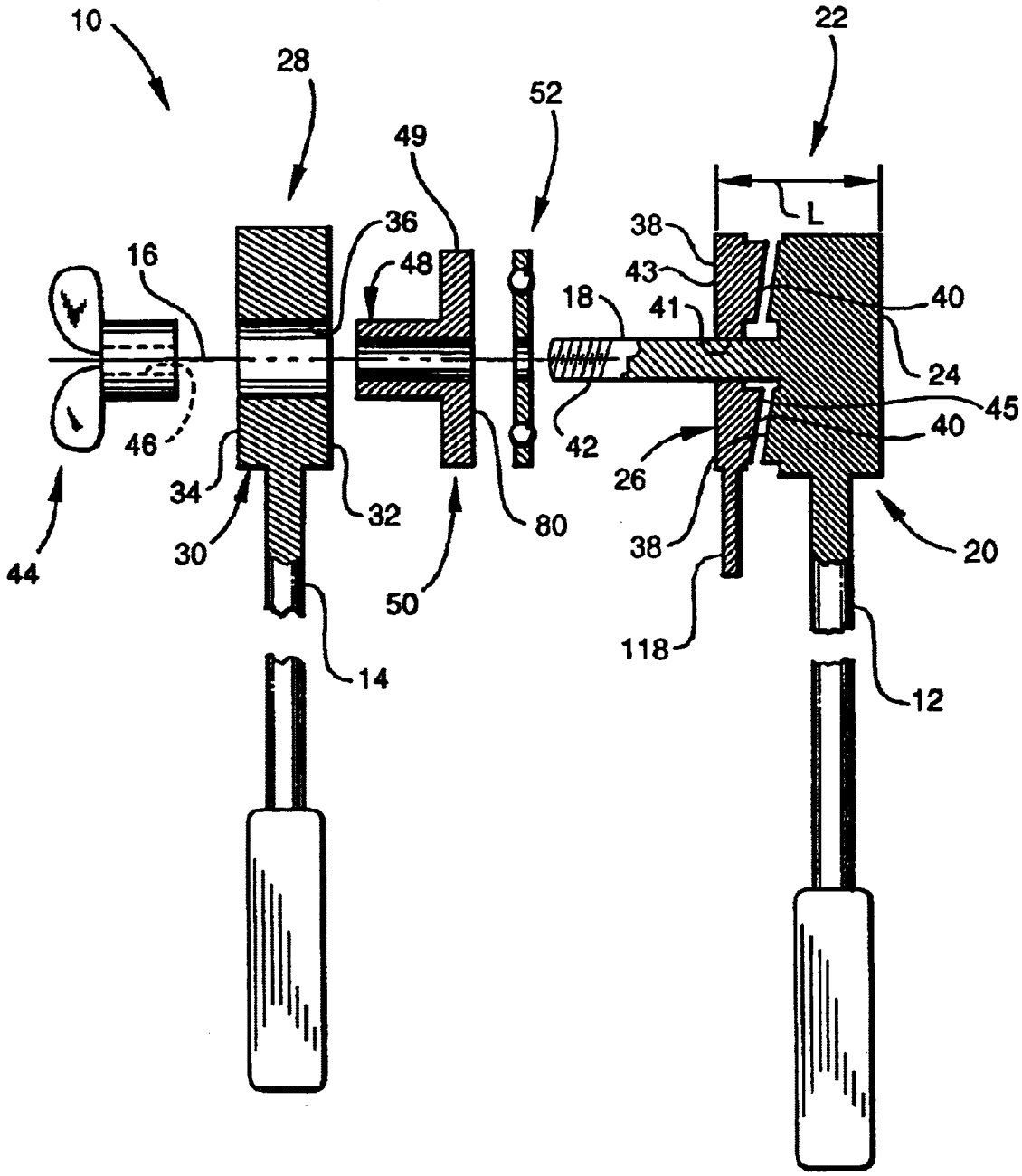
FIG. 1 is a side elevational view of one embodiment of the invention, shown partially in cross section.

Turning now to FIG. 1 of the drawings shows stepless, ratchet action, there is shown a rotational drive device 10 that provides both variable levels of adjustable rotational resistance and also selective direction in which the resistance acts. In the embodiment of FIG. 1, device 10 is arranged generally such that handles 12, 14 rotate relative to one another about rotational axis 16 in the manner of ordinary hand pliers (not shown) or the hands of a clock (not shown). In this embodiment, handles 12, 14 are each dimensioned and configured to cooperate with a person's hand to enable grasping. The embodiment depicted herein finds application as a hand held exercise device. However, it should be stated at the outset that novelty lies in the stepless ratchet mechanism and not necessarily in an embodiment having handles 12, 14. Handles 12, 14 facilitate explanation of operation of the invention and are not to be given limiting significance. Handles 12, 14 are merely representative of any engagement element which could be disposed upon bodies 20, 30 in order to attach to bodies 20, 30 to realize the benefits of variable resistance to mutual rotation of bodies 20, 30.

A shaft 18 is fixed to a body 20 of a first rotatable member 22 which includes handle 12. Axis 16 is the longitudinal axis of shaft 18. All references to axial motion and forces herein refer to axis 16. Body 20 has an exposed face 24 and an opposed internal face 26 from which shaft 18 projects. Second rotatable member 28 has a body 30 having an internal face 32 facing internal face 26 of body 20, and an external face 34. Body 30 has a smooth walled throughbore 36.

Figure 5:
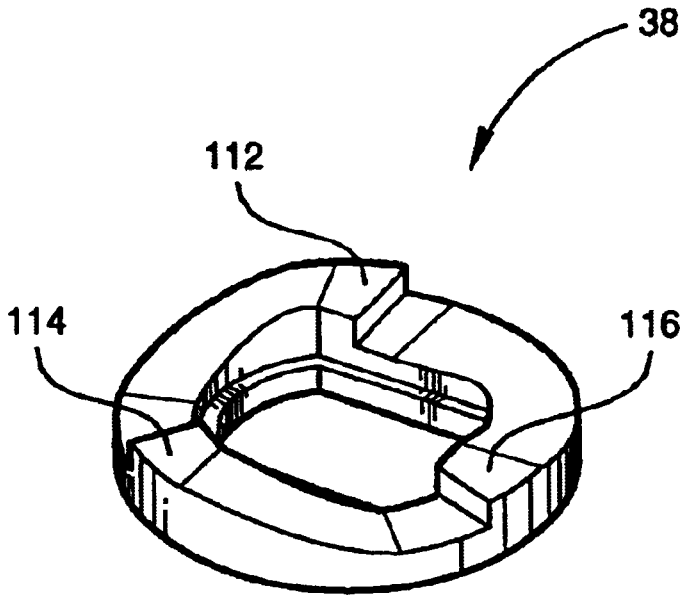
FIG. 5 is an enlarged perspective detail view of an element shown towards the upper right of FIG. 1.
Figure 6:
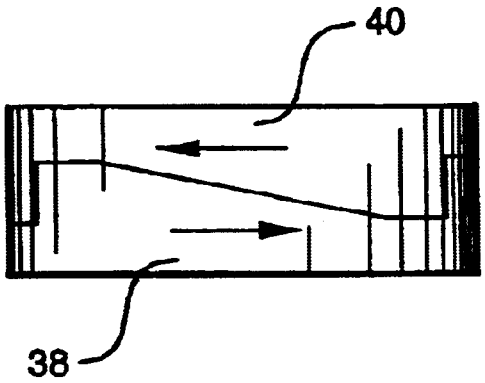
FIG. 6 is a diagrammatic, side elevational detail view of two elements similar to that shown in FIG. 5, shown in dovetailing relation.

Resistance to mutual rotation of rotatable members 22 and 28 is established by ramp elements 38, 40. Ramp element 38 is disposed upon internal face 26 of body 20. The first ramp element comprises a plurality of ramps (shown in detail in FIG. 5) formed at the top of a short upstanding wall disposed upon face 26. Depiction of ramped elements 38 and 40 in FIG. 1 is representative. FIGS. 5 and 6, which are described hereinafter, show ramped element 38 in a preferred actual configuration. Second ramp element 40 is separate from body 20, and has a throughbore 41 cooperating closely with shaft 18, so that ramp element 40 is rotatably supported on shaft 18. Ramp element 40 has an internal face 43 facing away from body 20 of first rotatable member 22, and an external face 45 bearing a plurality of ramps formed thereon. Ramps of ramp element 38 face ramps of ramp element 40, and interact to adjust the overall length L of body 20 in a manner to be further described hereinafter.

Adjustment of length L modifies axial compressive forces acting along axis 16. These axial compressive forces generate resistance to mutual rotation when members 22 and 28 are pressed against one another. Members 22 and 28 are pressed against one another by the following arrangement. Shaft 18 has threads 42 formed on its distal end, for receiving a nut 44 having mating threads 46. Nut 44 serves as a retainer disposed to retain second rotatable member 28, a collar 50, a bearing assembly 52, and ramped member 39 on shaft 18 of rotatable member 22.

A collar 50 acting as a compression transfer member has a hollow shaft 48 and a flange 49 having an end face 80. The opening of hollow shaft 48 enables shaft 18 to pass through collar 50. Shaft 48 is rotatably received within throughbore 36 of body 30 of member 28. An anti-friction bearing such as roller bearing assembly 52 is interposed between end face 80 of collar 50 and external face 43 of member 38 to assure smooth operation. Compressive forces pass through the collective assembly comprising collar 50, bearing assembly 52, member 38, and body 20 of member 22.

Body 30 of member 28 has incorporated therein a clutch disposed to couple rotatable member 28 selectively to rotatable member 22 such that resistance forces are established between members 22 and 30 selectively when member 22 is rotated in a first direction relative to member 30, in the opposite direction relative to member 30, and in both directions. It must be emphasized that this arrangement gives rise to three selectable modes of operation. In the first mode, resistance acts only in one rotational direction, but not in the second, opposite direction. This characteristic provides a ratchet effect with regard to the unidirectional direction of transmission of resistance forces. In the second mode, similar operation occurs, but with resistance acting in the opposite direction. In the third mode, resistance acts in both directions.

Figure 2:
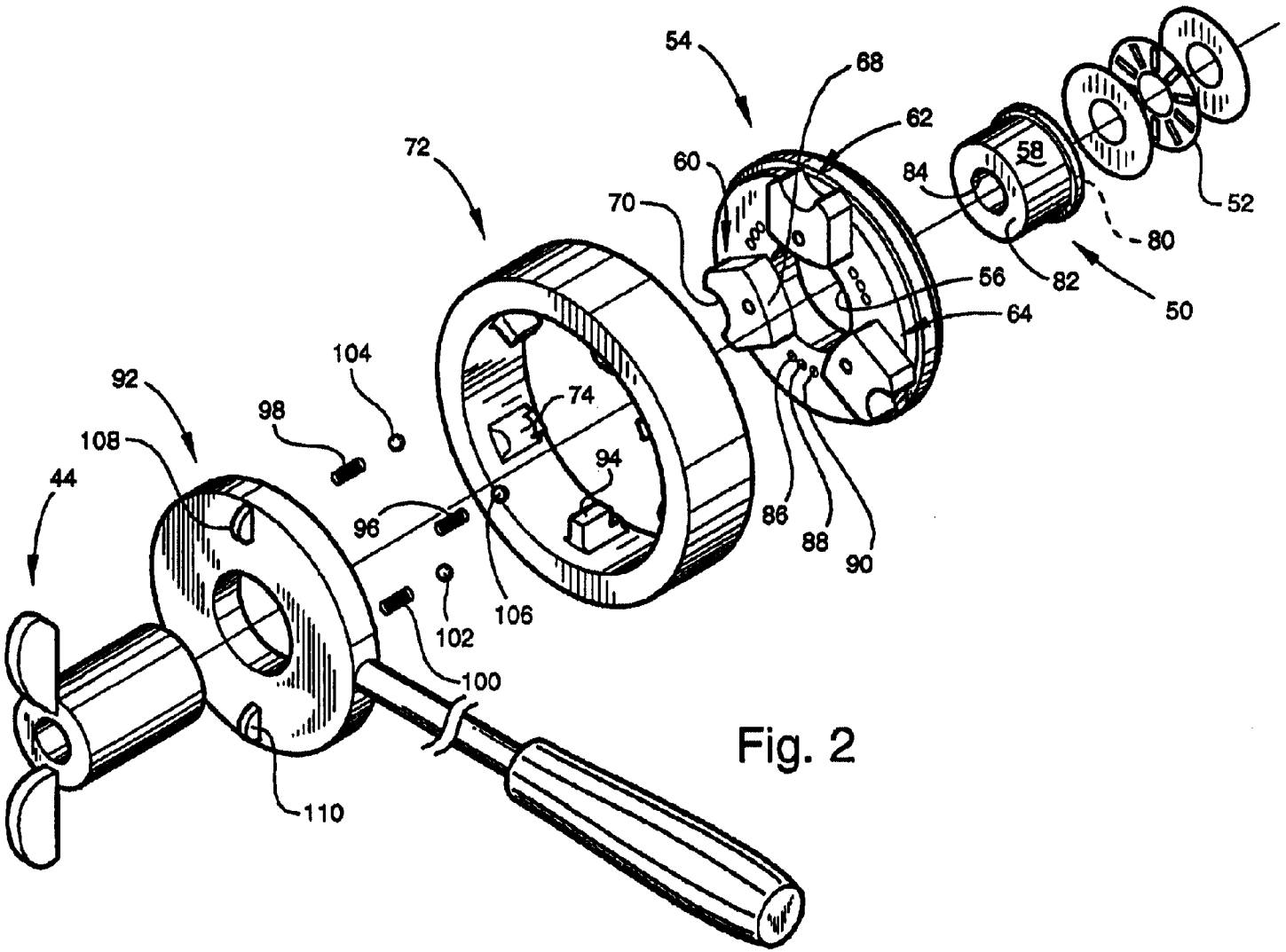
FIG. 2 is an exploded isometric view of the upper center of FIG. 1.

FIG. 2 shows details of the clutch, nut 44, and collar 50. The clutch comprises a base 54 having a central opening 56. Collar 50 projects through opening 56 such that outer lateral surface 58 is exposed to cam members 60, 62, 64. Cam members 60, 62, 64 are essentially similar. Therefore, only cam member 60 and its interaction with collar 50 will be described in detail, it being understood that similar principles apply to remaining cam members 62, 64. Cam member 60 has a curved surface 68 and an interiorly projecting valley 70. Cam member 60 is oscillatably mounted on base 54 on a pin 66. Oscillation is further described hereinafter.

Cam members 60, 62, 64 are simultaneously engaged and controlled by a selector 72. Selector 72 has a plurality of internal projections represented by projection 74, there being one projection for each cam member, this being shown in FIG. 3. Curved surface 68 of cam member 60, and therefore the corresponding curved surfaces of cam members 62 and 64, are dimensioned and configured such that they selectively bind against lateral surface 58 of collar 50 and slide easily without binding thereagainst, depending upon which part of the curved surface contacts surface 58. Clockwise and counterclockwise rotation of selector 72 determines binding and sliding.

Figure 3:
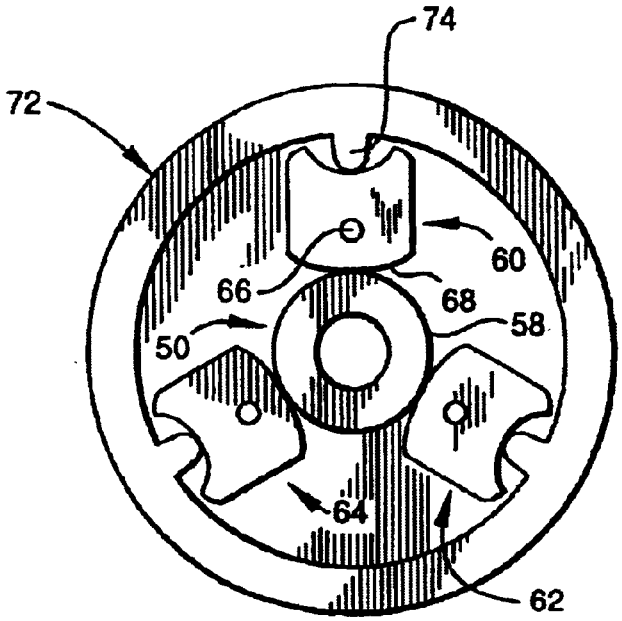
FIG. 3 is a top plan detail view of a component shown at the upper right of FIG. 2, and is drawn to larger scale.
Figure 4:
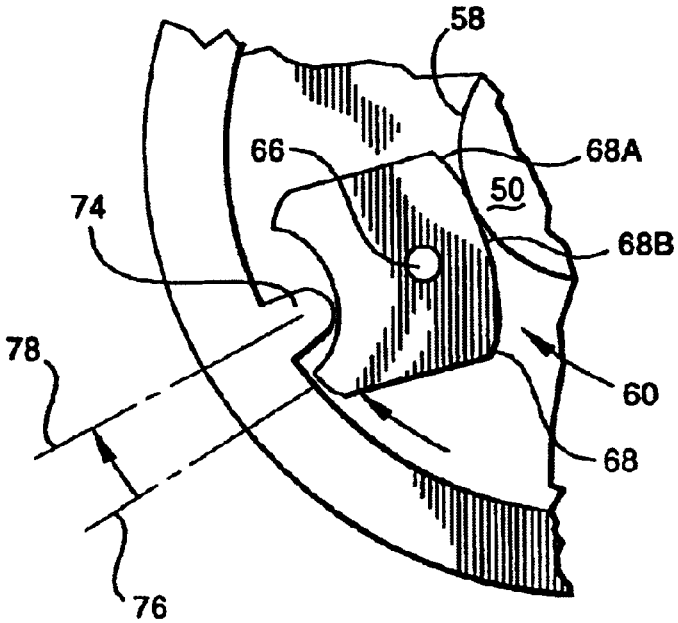
FIG. 4 is a top plan detail view of the top center of FIG. 3, showing some components moved from the position shown in FIG. 3, and is drawn to larger scale.

Turning momentarily to FIG. 4, it is seen that projection 74, which occupies valley 70 of cam member 60, has been moved to the left (in the depiction of FIG. 4) from the central position illustrated in FIG. 3 and indicated by projection line 76 in FIG. 4 to a new position indicated by projection line 78. Responsive to being urged by projection 74, cam member 60 oscillates slightly, rotating clockwise (in the depiction of FIG. 4) about pin 66 from its former central position shown in FIG. 3. A portion 68A of curved surface 68 now contacts surface 58 of collar 50. Cam member 60 is positioned by location of pin 66, and curvature of portion 68A is such, that rotation of selector 72 in one direction binds cam member 60 against surface 58 so that selector 72 and collar 50 move in tandem when rotatable members 22, 28 mutually rotate in a predetermined direction.

Curvature of surface 68 is such that when cam member 60 is rotated in a direction opposite that depicted in FIG. 4, clutching action is reversed. That is, when portion 68C of surface 68 contacts collar 50, compressive forces are transmitted to collar 50 when rotation of rotatable members 22, 28 is opposite that wherein compressive forces are transmitted in the depiction of FIG. 4. Slippage between cam member 60 and collar 50 results from mutual rotation in the opposite direction causing slippage when 68A contacts collar 50. The center of surface 68, shown as 68B, is dimensioned and configured such that contact with surface 58 causes mutual rotation of rotatable members 22, 28 to cause binding in both directions.

In summary, rotation of selector 72 selectively urges cam members 60, 62, 64 into one of a first position, a second position, and a third position relative to collar 50. In the first position, the clutch operably couples rotatable member 28 to collar 50 when rotatable members 22, 28 are mutually rotated in a first direction and releases rotatable member 28 from collar 50 when rotatable members 22, 28 are mutually rotated in a second, opposing direction. In the second position, the clutch operably couples rotatable member 28 to collar 50 when mutual rotation is in the second, opposing direction, and operably uncouples rotatable member 28 from collar 50 when mutual rotation is in the first direction. In the third position, the clutch operably couples rotatable member 28 to collar 50 when mutual rotation of members 22, 28 proceeds in either one of both directions. The significant advantage of the clutch arrangement described herein is that rotatable members 22, 28 mutually rotate in a stepless manner.

Returning to FIG. 2, it is seen that end face 80 of collar 50 faces rotatable member 22 (see FIG. 1), and end face 82 faces nut 44. Bearing assembly 52 is preferably a roller bearing assembly rather than being the ball bearing assembly shown symbolically in FIG. 1. Bearing assembly 52 could be a conical bearing assembly if desired. Another characteristic of collar 50 shown in FIG. 4 is smooth walled throughbore 84, which enables collar 50 to slide easily axially over shaft 18 (see FIG. 1) when the latter passes through throughbore 84. This enables collar 50 to come into intimate contact with bearing assembly 52 when imposing axial compressive forces on body 30 of rotatable member 28.

The clutch includes a detent device disposed to selectively immobilize selector 72 such that selector 72 maintains cam members 60, 62, 64 in the selected one of the first position, the second position, and the third position. Maintaining the selected position does not prevent adjustment of selector 72 to another position, but rather constrains selector 72 from casual or spontaneous, unintended departure from a selected position. To this end, base 54 has three depressions drilled thereinto between each pair of cam members 60, 62, 64. The set of three depressions 86, 88, 90 will be described and will be understood to perform the same functions as the sets of depressions shown but not explicitly described. The detent device includes a cap 92 which fits into selector 72. Cap 92 is supported on the uppermost surfaces of the projections (such as projection 74) which operate cam members 60, 62, 64 and of additional projections (such as projection 94) provided solely for support of cap 92. In the depiction of FIG. 2, the upper surfaces of the projections face to the left.

Three coil springs 96, 98, 100 are fixed to cap 92 and project towards base 54. A ball 102, 104, or 106 is aligned with each spring 96, 98, or 100 such that its associated spring 96, 98, or 100 urges the ball 102, 104, or 106 against base 54. Depressions 86, 88, 90 and other depressions shown but not explicitly aligned are located such that when one ball 102, 104, or 106 interfits with and engages one depression, the other balls will interfit with and engage other corresponding depressions such that all balls are simultaneously seated in some of the depressions. Spring force overcomes minor, random motions which would otherwise unseat the balls and cause selector 72 to rotate from its selected position.

When the components shown in FIG. 2 are operatively assembled, they are entrapped on shaft 18 by nut 44. Cap 92 may be rotated so that selector 72 may be moved among the various positions by grasping ears 108, 110. In actual practice, flat washers (not shown) are preferably placed on both sides of roller bearing assembly 52 and between any other two components where friction or wear is deemed objectionable.

The nature of ramp elements 38 and 40 will now be described. Referring to FIG. 5, the short upstanding wall formed ramp element 38 of rotatable member 22 is seen to have three inclined ramps 112, 114, 116 arranged in serial fashion at the upper surface of the wall. As seen in FIG. 6, ramp member 40 has essentially similar configuration as member 38, and is configured to complement and to face member 38 such that members 38 and 40 interfit closely in dovetailing fashion. When ramp elements 38 and 40 are rotated in directions indicated by arrows in FIG. 6, they will remain in contact, but will move axially to adjust overall length L of rotatable member 22. This is accomplished by grasping tension adjustment lever 118 (see FIG. 1) and rotating ramp member 40 relative to rotatable member 22. Ramp members 38 and 40, and collar 50 are formed from a strong, elastic material such as a mildly elastic steel alloy.

The present invention is susceptible to variations and modifications which may be introduced thereto without departing from the inventive concept. For example, handles 12, 14, are one form of engagement members which may be provided to operably engage the user or alternatively, an environmental object. The novel drive device, rather than having two handles, may have only one handle. The handles may be modified such that they are not literally handles, but instead comprise engagement members which are adapted to engage a body limb other than the hand, or which may be adapted to engage apparel or a belt or harness worn by a user, or to engage the user in any other way. An engagement member may be other than a lever as depicted in FIG. 1. Illustratively, rotatable member 22 may have a socket, hexagonal drive element, or other structure (none shown) fixed to exposed face 24. The device may be configured to cooperate with a machine, which need not necessarily be an exercise machine. In a further example, order of the components may be varied from that described herein. For example, the ramps may be relocated to the other side of the bearing assembly.

It is to be understood that the present invention is not limited to the embodiments described above, but encompasses any and all embodiments within the scope of the following claims.

I claim:

1. A stepless, ratchet action, rotational drive device that provides both variable levels of adjustable rotational resistance and also selective direction in which the resistance acts, comprising:

a first rotatable member having a body including an exposed face, an opposed internal face, a shaft projecting from said internal face, a first ramp element disposed upon said internal face, wherein said first ramp element has a plurality of ramps formed thereon, and a first engagement member disposed upon said body of said first rotatable member;

a second ramp element rotatably supported on said shaft, bearing an internal face facing away from said first rotatable member and an external face bearing a plurality of ramps formed thereon, wherein said ramps of said second ramp element face said ramps of said first ramp element;

a second rotatable member constrained to rotate about said shaft, having a body including an external face, an internal face facing said internal face of said first rotatable member, and a second engagement member disposed upon said body of said second rotatable member;

an anti-friction bearing disposed between said internal face of said second ramp element and said second rotatable member;

a clutch disposed to couple said first rotatable member selectively to said second rotatable member such that resistance forces are established between said first rotatable member and said second rotatable member selectively when said first rotatable member is rotated in a first direction relative to said second rotatable member, and when said first rotatable member is rotated in an opposed second direction relative to said second rotatable member; and a retainer disposed to retain said second rotatable member on said shaft of said first rotatable member.

2. The drive device according to claim 1, wherein said clutch is incorporated into said second rotatable member and is rotatably supported on said shaft of said first rotatable member, and said clutch further includes a compression transfer member which is disposed between said body of said second rotatable member and said internal face of said second ramp element, is constrained to move axially along and to rotate about said shaft of said first rotatable member, and transmits compressive forces between said first rotatable member and said second rotatable member, wherein said clutch selectively couples said second rotatable member to and uncouples said second rotatable member from said compression transfer member.

3. The drive device according to claim 2, wherein said compression transfer member is a collar having a smooth walled throughbore, an outer lateral surface, a first end face facing said second rotatable member, and a second end face facing said second ramped member.

4. The drive device according to claim 3, wherein said clutch incorporates a base and a plurality of oscillatable cam members oscillatably mounted on said base, wherein said cam members each have a curved cam surface disposed selectively to bind on said outer lateral surface of said collar and to slide without binding on said outer lateral surface of said collar.

5. The drive device according to claim 4, further comprising a selector disposed to urge said cam members selectively into a first position wherein said clutch operably couples said first rotatable member to said collar when said first rotatable member is rotated in a first direction relative to said second rotatable member and releases said first rotatable member from said collar when said first rotatable member is rotated in a second opposing direction relative to said second rotatable member, and into a second position wherein said clutch operably couples said first rotatable member to said collar when said first rotatable member is rotated in the second opposing direction relative to said second rotatable member and releases said first rotatable member from said collar when said first rotatable member is rotated in the first direction relative to said second rotatable member.

6. The drive device according to claim 5, wherein said selector is disposed to urge said cam members into a third position wherein said clutch operably couples said first rotatable member to said collar both when said first rotatable member is rotated in the first direction relative to said second rotatable member and also when said first rotatable member is rotated in the second opposed direction relative to said second rotatable member.

7. The drive device according to claim 5, further comprising a detent device disposed to selectively immobilize said selector such that said selector maintains said cam members selectively in said first position and in said second position.

8. The drive device according to claim 1, wherein said body of said second rotatable member has a smooth walled throughbore enabling said shaft of said first rotatable member to pass through said throughbore.

9. The drive device according to claim 1, wherein said shaft has a proximal end anchored to said first rotatable member and a distal end bearing threads thereon, and said retainer comprises a threaded nut disposed to thread onto and from said threads of said shaft.

10. The drive device according to claim 9, wherein said base of said clutch includes a plurality of depressions, and said detent device comprises at least one ball dimensioned and configured to interfit with and engage each one of said depressions, and one spring for each ball, wherein each said spring is mounted within said selector and is disposed to urge said ball into one of said depressions of said base of said clutch.

11. The drive device according to claim 1, wherein said engagement member of said first rotatable member comprises a handle configured to cooperate with a person's hand.

12. The drive device according to claim 11, wherein said engagement member of said second rotatable member comprises a handle configured to cooperate with a person's hand.

* * * * *